US006280787B1

(12) United States Patent
Perry

(10) Patent No.: US 6,280,787 B1
(45) **Date of Patent: *Aug. 28, 2001**

(54) GAS FLUSHING METHOD

(75) Inventor: Michael R. Perry, Plymouth, MN (US)

(73) Assignee: The Pillsbury Company, Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/070,101

(22) Filed: Apr. 27, 1998

Related U.S. Application Data

(60) Continuation of application No. 08/618,901, filed on Mar. 20, 1996, now abandoned, which is a division of application No. 08/538,182, filed on Aug. 23, 1995, now Pat. No. 5,520,101, which is a continuation of application No. 08/113,276, filed on Aug. 27, 1993, now abandoned.

(51) Int. Cl.[7] ..... B65B 31/06; B65B 31/00

(52) U.S. Cl. ..... 426/397; 426/486; 426/496; 53/432

(58) Field of Search ..... 426/404, 414, 426/486, 418, 496; 53/432, 436, 527, 510, 433, 434

(56) References Cited

U.S. PATENT DOCUMENTS

| | | | | |
|---|---|---|---|---|
| 668,303 | | 2/1901 | Beyer . | |
| 1,109,976 | | 9/1914 | Fenn . | |
| 1,406,380 | * | 2/1922 | Heath et al. | 426/397 |
| 1,475,469 | | 11/1923 | Bach . | |
| 1,494,321 | | 5/1924 | Posey . | |
| 1,938,821 | | 12/1933 | Fenn . | |
| 2,064,678 | | 6/1936 | Morgan . | |
| 2,338,012 | * | 12/1943 | Schmitt | 426/404 |
| 2,518,100 | * | 8/1950 | Tomkins | 426/418 |
| 2,863,267 | * | 12/1958 | Moore | 426/410 |
| 2,967,777 | * | 1/1961 | Grindrod | 426/418 |
| 3,393,491 | | 7/1968 | Burton et al. . | |
| 3,524,297 | * | 8/1970 | Falborg | 54/432 |
| 3,748,818 | | 7/1973 | Rousseau . | |
| 3,748,819 | * | 7/1973 | Christensson | 53/527 |
| 4,018,030 | * | 4/1977 | Christensson | 53/527 |
| 4,039,695 | | 8/1977 | Johnson . | |
| 4,094,121 | * | 6/1978 | Ganholt | 53/432 |
| 4,114,348 | | 9/1978 | Mahaffy et al. . | |
| 4,154,045 | * | 5/1979 | Christensson | 53/436 |
| 4,506,600 | | 3/1985 | Hersom et al. . | |
| 4,513,015 | | 4/1985 | Clough . | |
| 4,646,627 | * | 3/1987 | Bartfield et al. | 426/438 |
| 4,744,204 | * | 5/1988 | Schlegel | 426/397 |
| 4,982,555 | | 1/1991 | Ingemann . | |
| 5,069,020 | | 12/1991 | Sanfilippo et al. . | |
| 5,155,971 | | 10/1992 | Zopf . | |

FOREIGN PATENT DOCUMENTS

| | | | | |
|---|---|---|---|---|
| 23746 | * | 2/1981 | (EP) | 53/432 |
| 1412688 | * | 11/1975 | (GB) | 426/404 |

* cited by examiner

*Primary Examiner*—Steven Weinstein
(74) *Attorney, Agent, or Firm*—Mark W. Binder

(57) ABSTRACT

The present invention includes a gas flushing device that includes a piston portion having a hole to introduce the flushing gas. The present invention also includes a method for removing air from a container that stores food. The method includes providing the gas flushing device and aligning the device with the container. The method also includes moving the piston of the device into the container until the piston encounters a predetermined pressure. Next, the piston is retracted from the container while simultaneously releasing a fushing gas through the hole. Next, the piston is removed from the container and the container is sealed in an inert atmosphere.

18 Claims, 2 Drawing Sheets

GAS FLUSHING METHOD

This application is a continuation of U.S. application Ser. No. 08/618,901 filed Mar. 20, 1996, now abandoned, which is a divisional of U.S. application Ser. No. 08/538,182 filed Aug. 23, 1995, now U.S. Pat. No. 5,520,101, which is continuation of U.S. application Ser. No. 08/113,276 filed Aug. 27, 1993, now abandoned.

BACKGROUND OF THE INVENTION

The present invention relates to a process and a device for mechanically flushing storage containers with gases.

The preservation of stored degradable food products on a scale permitting mass consumption has presented problems to manufacturers since canned meat and vegetables were first introduced to British consumers in about 1818. One cause of persistent problems in uniformly preserving stored foods on a scale of mass consumption, ironically, includes a steady development of new food products. The new food products have required new processes and devices for preserving the produces during storage. Unfortunately, the development of new processes and devices for food storage has, in some instances, lagged behind new product development. Consequently, existing processes and devices have been enlisted to store the new products. Because the existing processes and devices do not optimally preserve the new products, the existing storage processes and devices cause preservation problems.

The processes and devices employed to preserve the stored food products are typically directed to degradation problems that are common to both testing food products and to new food products. For instance, many kinds of food products are rendered unpalatable by undesirable oxidation reactions occurring during storage. The oxdation reactions may occur as a result of a prolonged exposure of the food to air. For many types of food products then, preservation during storage hinges on whether air is adequately removed from a storage container prior to sealing food into the container.

For some types of food products, food quality is enhanced by creating and maintaining particular gas compositions within a storage container. The gas compositions may be evolved by the food product itself or may be added to the product prior to storage.

One method for removing air from a container storing food has included applying a vacuum to the food container to displace the air. Once air is displaced, the food container may remain under vacuum or be backflushed with a desired gas or gas composition. A vacuum may be applied by heating the food and a sealable container, thereby driving air out of the container and cooling the food and container so that the container is sealed during cooling. A vacuum may also be applied by mechanically pulling the air out of the container. The appropriate method of applying a vacuum depends upon the type of food to be stored and upon whether the food can withstand the conditions of particular vacuum generating methods.

Air removal by a generation of a vacuum tends to be excessively time consuming. Additionally, backflushing adds more time. Further, some storage containers won't retain a vacuum. Both heating and cooling to generate a vacuum and mechanical generation of a vacuum to evacuate air require a substantial number of steps. The steps have a significant time requirement for completion.

The generation of a vacuum to evacuate air also tends to be expensive because it requires specialized equipment and substantial energy to generate heat in order to drive air out of the storage container. Additionally, methods relying on a generation of a vacuum lack versatility. Thus, the methods are not easily adaptable to new foods having characteristics that can be damaged in the generation of a vacuum. Further, air removal by imposition of a vacuum tends to yield variable results.

In addition to evacuating air by vacuum, air removal methods have also included sparging air from a headspace of food storage containers with a charge of a sparging gas. However, existing air sparging processes have tended to be time consumming. Additionally, sparging the headspace of a dough product has required a substantial amount of sparging gas to reduce gas concentration. For instance, for a container storing dough having a headspace of about 50 cubic centimeters, about 500 cubic centimeters of flushing gas are required to reduce oxygen in the headspace from about 20 percent to 2 percent.

SUMMARY OF THE INVENTION

The present invention includes a device for flushing gas in a container that includes a main body that includes a piston portion having a hole. The main body is attachable to a source of flushing gas.

The present invention also includes a method for removing air from a container that stores food. The method includes providing the gas flushing device and moving the piston portion of the device into the container until the piston portion encounters a predetermined force. Next, the piston portion is retracted from the container while simultaneously releasing a flushing gas through the hole. Next, the piston portion is removed from the container and the container is sealed.

DETAILED DESCRIPTION OF THE PREFERRED EMBODIMENTS

Figure 1A:
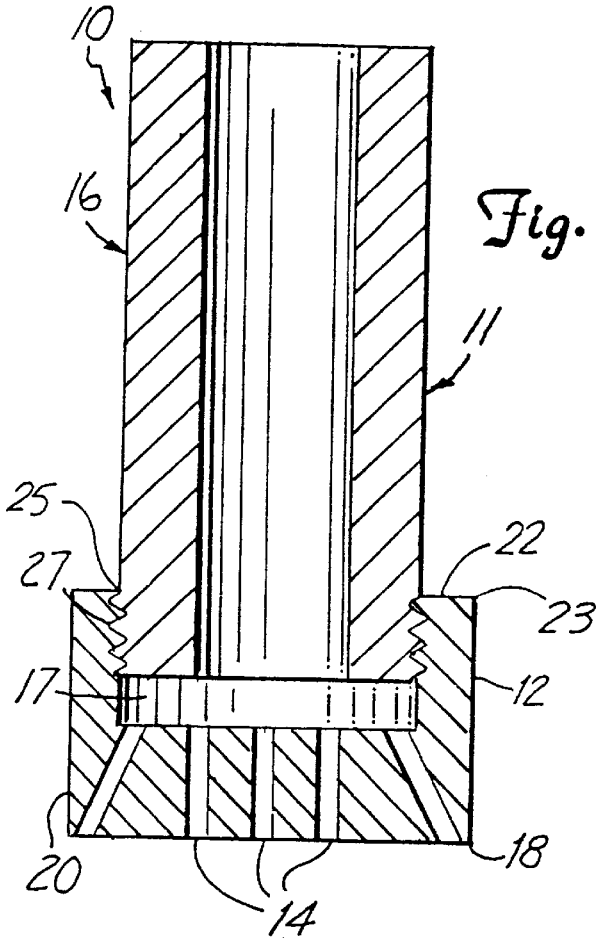
FIG. 1A shows a cross-sectional view of one embodiment of the gas flushing device of the present invention.

The gas flushing device of the present invention, illustrated generally at 10 in FIG. 1A, includes a main body 11 having a piston portion 12 with holes 14 that is connected to a piston rod 16. The piston rod 16 is in communication with a source of a flushing gas such as carbon dioxide. The piston rod 16 conveys flushing gas to a chamber 17 in which the flushing gas under pressure exits through holes 14. The present invention also includes a process for mechanically flushing air form a container having food that includes providing the gas flushing device 10 of the present invention, providing a container containing food, aligning the piston portion 12 of the device 10 to fit within the container, moving the piston portion 12 downward into the container until the piston portion 12 contacts a food product and subsequently encounters a predetermined force, introducing flushing gas at a rate effective to prevent creation of a vacuum in the container, retracting the piston portion 12 while in an environment substantially free of air and while cloning to introduce the flushing gas into the container through holes 14 in the piston portion 12, removing the piston portion 12 from the container, sealing the container in an environment substantially free of air and shutting off the flush gas supply.

The gas flushing device 10 of the present invention, when used with a container storing a dough material, aids in preventing the formation of "grey dough." Grey dough occurs as a consequence of dough being exposed to an excessive amount of oxygen In particular, dough acquires a grey color when oxygen within a container reacts with dough constituents during storage. It is believed that an oxygen, concentration of as little as one to two percent within the container will result in grey dough.

The gas flushing device 10 is also useful in preventing an unwanted oxidation of other non-granular food products as well. The gas flushing device 10 provides this benefit without adversely impacting flavor, texture, fat distribution, and without causing undesirable bacterial growth or causing a premature packaging failure by permitting a leakage of syrup from a stored food through the package. By preventing oxidation of food, the gas flushing device 10 aids in increasing the time that degradable foods may be stored.

The gas flushing device 10 offers a versatility to food storage by permitting a selection of desired flushing gas used in the storage of food. For instance, the flushing gas may be either a single gas or a mixture of gases. The flushing gas may be selected to enhance other attributes of the food stored. The flushing gas may also be formulated to retard microbial activity.

In one preferred embodiment, the piston portion 12 of the gas flushing device 10 includes a bottom surface 18 that is substantially circular. The circular bottom surface 18 is of a diameter that is less then a diameter of a cylindrical storage container only to a degree that permits the piston portion 12 to move within the container without contacting a radial wall of the container and to press down upon the food in the container. The circular bottom surface 18 is of a diameter that allows any gas in the container to exit the can as it is displaced by the piston. The bottom surface 18 includes a flat bottom surface embodiment and a carved bottom surface embodiment. The bottom surface 18 of the piston portion 12 is preferably made of a non-stick material such as nylon or teflon.

The piston portion 12 also includes a cylindrical surface 20 that meets the bottom surface 18 at the circumference of the bottom surface 18. For a flat bottom surface 18, the cylindrical surface 20 is substantially perpendicular to the bottom surface 18.

The piston portion 12 also includes at least one hole 14. In one embodiment, the hole 14 is positioned in the bottom surface 18 of the piston 12. In another embodiment the hole 14 is positioned within the cylindrical surface 20. In one other embodiment, the piston 12 includes a plurality of holes that are located on each of the bottom surface 18 and the cylindrical surface 20.

The piston portion 12 is securely attached to the hollow rod portion 16 by a threaded section 25 on the rod portion 16 that engages a threaded section 27 on the piston portion 12. The rod portion 16 may be detached from the piston portion 12 by disengaging the threaded sections, thereby facilitating cleaning of the flushing device 10.

The piston rod portion 16 of the main body 11 shown in FIG. 1A is a hollow rod. The piston rod portion 16 is in communication with a source of fushing gas by any conventional coupling for attaching gas transfer components. In one embodiment, the piston rod portion 16 and piston portion 12 are parts of a single substantially hollow main body 11.

Figure 1B:
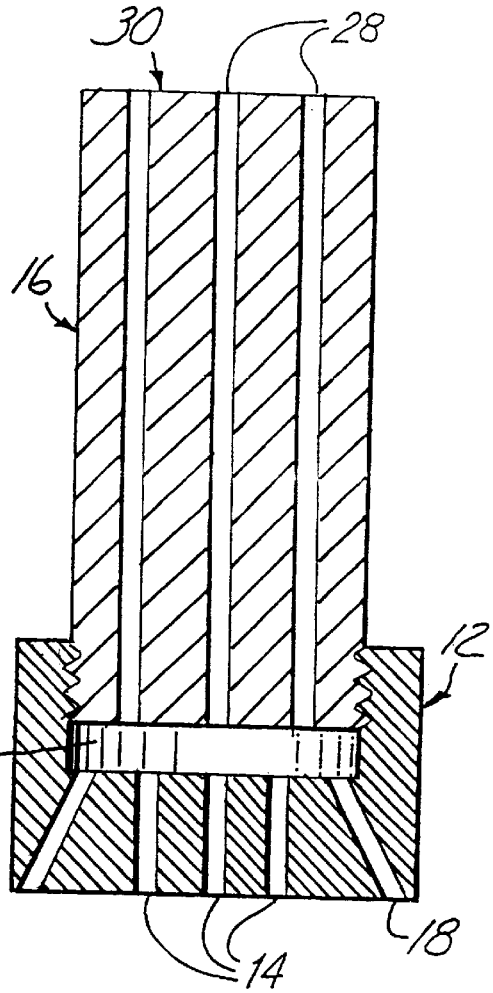
FIG. 1B shows a cross-sectional view of one other embodiment of the gas flushing device of the present invention.

In one other embodiment illustrated at in FIG. 1B, the piston rod portion 16, and piston portion 12 are parts of a substantially solid main body having passages 28 for flushing gas flow from a flushing gas source through the holes 14. The passages 28 extend from the piston rod 16 through the chamber 17 to the bottom surface 18.

The piston portion 12 of the gas flushing device 10 is sized and shaped to fit within a storage container and to substantially compress the food product within the container. In one preferred embodiment, the container is of a cylindrical shape.

The mechanical gas flushing process of the present invention is an improvement over existing methods of removing air from a food storage container because the gas flushing process does not depend upon the generation of a vacuum to remove the air. Further, the gas flushing process does not rely upon gas sparging and flushing as a singular step in removing oxygen from a container. Instead, the gas flushing process utilizes the steps of displacing gas with the piston, compressing a food in order to displace additional air and gases within the food and then flushing the food container with flushing gas as the piston is retracted under a substantially air free environment. The food container may also be flushed with flushing gas as the piston displaces gas and compresses food in the container. Further manipulations of the food container, such as sealing the container, occur in an atmosphere that is substantially air free.

The gas flushing process increases the speed at which air removal can occur as compared to other air removal methods. It is believed that a container can be flushed with gas in a time of one second or less.

Additionally, the gas flushing process offers great versatility in air removal within a food container. In particular, the gas flushing process permits flushing gases to be added to the container during the compression of the food by the piston portion 12 of the gas flushing device 10 and during retraction of the piston portion 12. This addition of gases is a significant improvement over existing storage processes. Further, the gas flushing device 10 permits just about any type of gas mixture to be employed in the removal of air from a food container.

In one preferred embodiment, the gas flushing device 10 of the present invention is used in a process to flush air from a container storing a prepared dough product The prepared dough product undergoes a leavening reaction within the container during storage. The leavening reaction results in a generation of carbon dioxde within the dough which results in an expansion of the prepared dough product.

The prepared dough product is a preferred product for use with the gas flushing device 10 of the present invention because the dough is compressible by the piston portion 12 of the gas flushing, device 10. The piston 12 forces trapped air from sides of dough. However, it should be understood that the process for gas flushing, is usable for materials other than bread doughs, such as cookie doughs and other non-granular foods.

Figure 2:
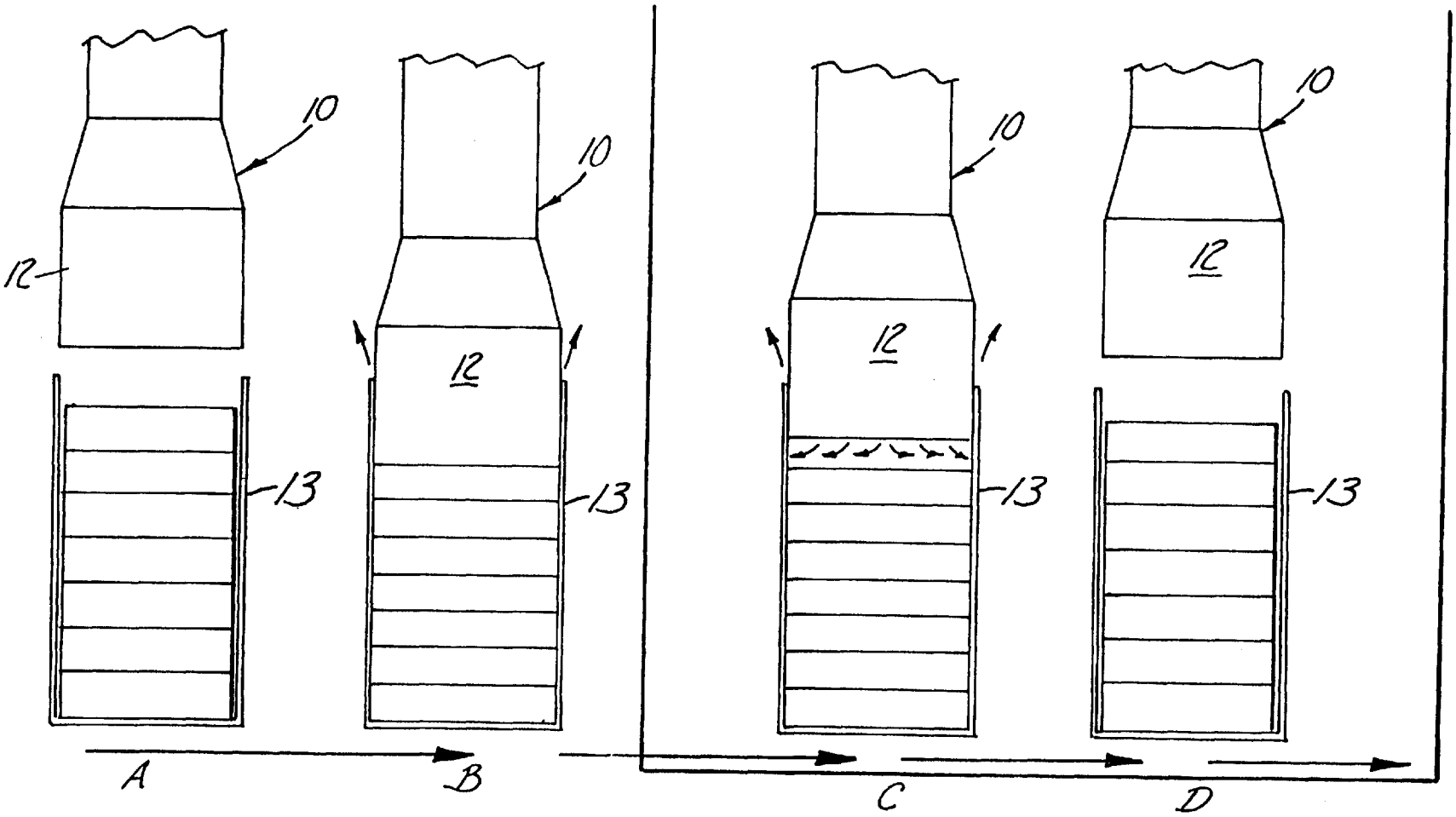
FIGS. 2A, 2B, 2C and 2D show a schematic view of one other embodiment of the mechanical gas flushing process of the present invention.

Once a storage container 13 is substantially filled with dough, the container 13 and the piston portion 12 are aligned so that the piston portion 12 of the gas flushing device 10 can be inserted into the container 13. One example of this positioning is shown in FIG. 2 at A. It is not of consequence to the process of the present invention that the container 13 is moved to the gas flushing device 10, the alas flushing device 10 is moved to the container 13 or both the flushing device 10 and the container 13 move. What is important is that a condition is reached where the storage container 13 is positioned beneath the piston portion 12 of the gas flushing device 10 so that the piston portion 12 can be inserted into the container 13.

In a next step illustrated at B in FIG. 2, the gas flushing device 10 is moved downward into the storage container 13. The gas flushing device 10 is moved by energy such as is provided by a spring or compressed air in communication with the device 10 that is transmitted to the gas flushing device 10. For this embodiment, the spring or compressed air imparts a force to the piston portion 12 that the piston portion 12 imparts to the dough.

In one embodiment of the gas flushing process, the dough is compressed with the piston portion 12 as the piston portion 12 is moved downward. The piston portion 12 of the present invention applies a force to the dough that does not damage the dough. Once compressed, the dough deforms because of its particular viscous properties and conforms to the available compressed space. Compressing the dough with the piston portion 12 forces gases within and proximal to the dough to be expelled from the container 13.

The downward motion of the gas flushing device 10 is continued until the piston portion 12 encounters a particular predetermined force. In one embodiment, the force is measurable as a pressure applied to the piston portion 12 by the dough and by gases within the dough. Once a particular pressure has been applied to the piston portion 12, an actuator (not shown) retracts the gas flushing device 10 as shown at C in FIG. 2. In one embodiment, the piston portion 12 is in communication with a spring that is expanded as the piston portion 12 is moved downward and is compressed when the piston portion 12 is moved upward. The piston portion is moved downward until the spring is expanded to a preset degree, imparting a predetermined force to the piston 12.

In another embodiment, the gas flushing device 10 is regulated to have a particular stroke length. The regulation of stroke length may be performed by any conventional method in communication with a timing mechanism, such as a timing screw.

In one embodiment as the gas flushing device 10 is retracted, gas is simultaneously introduced into the storage container through the holes 14 in the piston portion 12. In another embodiment, the flushing gas is introduced into the storage container when the device 10 is initially inserted into the container. As discussed, the flushing gas may be a gas such as carbon dioxide or a mixture of gases. In one other embodiment, the flushing gas is nitrogen. It is also contemplated in the process of the present invention, that the flushing gas would be a mixture of inert gases.

In one embodiment, a controller prompts an actuator to open a flushing gas line simultaneously with a prompt to retract the piston portion 12. In another embodiment, a timing mechanism prompts an actuator to open the flushing gas line as the piston portion 12 retracts.

The process of the present invention may be regulated by conventional control schemes and equipment. In one embodiment, the cycling of the piston portion 12 and the introduction of flushing gas may be controlled by a timing screw that is in communication with the gas flushing device 10, a source of flushing gas and a seamer, used to seal the storage container.

When the piston portion 12 reaches the top of the storage container 13 and is about to be removed from the container, the piston portion 12 and the container 13 are positioned within an enclosure 15 as shown at C and D in FIG. 2. The enclosure 15 encloses a space that is substantially free of air. The enclosure 15 contains an atmosphere that is substantially one of a gas such as carbon dioxide. Within the enclosure 15, the piston portion 12 is removed from the container 13 and the container 13 is sealed from the external environment. In one preferred embodiment, the container 13 is sealed by seaming with a seaming device (not shown).

In one preferred embodiment for the prepared dough product, the storage container 13 is flushed to an oxygen concentration that is less than 1%. The reduced oxygen concentration in the storage container 13 after sealing is an improvement over the present methods. The reduced oxygen concentration is achieved without having to rely on rising dough to pressurize and remove headspace.

In one preferred embodiment, the container 13 is sealed by a seaming device (not shown) within the enclosure 15. However, any method of sealing a container 13 is suitable for use in the method of the present invention.

Although the present invention has been described with reference to preferred embodiments, workers skilled in the art will recognize that changes may be made in form and detail without departing from the spirit and scope of the invention.

What is claimed is:

1. A method of removing undesirable gas from a container having an interior cavity and an opening for providing access to the interior cavity of the container, the container having a food product disposed within the interior space of the container, said method comprising the steps of:

providing a displacement member including a piston portion that is sized and shaped to permit the piston portion to pass through the opening of the container, the piston portion also comprising at least one flushing gas supply passage having an outlet that opens through a surface of the piston portion;

positioning the displacement member relative to the container so that the container opening is aligned with the piston portion of the displacement member;

moving the displacement member and the container relatively toward one another so that the piston portion is inserted through the container opening and at least partially within the interior space of the container until a surface portion of the piston portion contacts the food product within the interior space, said step of moving the displacement member and the container relatively toward one another thereby causing a positive displacement of a quantity of undesirable gas from within the interior space of the container by forcing undesirable gas out of the interior space of the container by gas flow about the piston portion;

moving the displacement member and the container relatively away from one another so that the piston portion is moved along the interior space of the container; and supplying flushing gas under a positive pressure within the flushing gas supply passage during the step of moving the displacement member and container relatively away from one another and while the outlet of the flushing gas supply passage is within the interior space of the container so that flushing gas is ejected into the interior space of the container.

2. The method of claim 1, wherein said step of moving the displacement member and the container relatively toward one another is conducted beyond the point at which the surface portion of the piston portion contacts the food product within the interior space for compressing the food product and forcing undesirable gas from the food product, which undesirable gas from the food product is also displaced from within the interior space of the container by the piston portion.

3. The method of claim 2, wherein the compression of the food product is stopped when a predetermined force is encountered by the piston portion.

4. The method of claim 2, wherein flushing gas is also supplied while the displacement member and container move relatively toward one another including while the food product is compressed.

5. The method of claim 1, wherein the flushing gas is supplied at a rate sufficient to prevent creation of a vacuum within the interior space of the container while the displacement member and container move relatively away from one another.

6. The method of claim 5, wherein the flushing gas is directed from the outlet of the flushing gas supply passage so as to impinge onto a surface of the food product.

7. The method of claim 5, wherein the piston portion is shaped similar to the opening of the container and is sized so as to permit passage of the piston portion into the interior space of the container, but to allow flow of undesirable gas from the interior space of the container between the piston portion and the container, the piston portion thus providing a surface for contacting substantially all of an exposed surface area of the food product when the contact between the piston portion surface and food product occurs.

8. The method of claim 5, further comprising a step of sealing the container in an environment that is free of the undesirable gas after said step of moving the displacement member and the container relatively away from one another is conducted to a point where the piston portion is removed from the container.

9. The method of claim 8, wherein the food product provided within the interior space of the container is a dough product that is compressed during said step of moving the displacement member and the container relatively toward one another, and the step of supplying flushing gas comprises supplying $CO_2$ as the flushing gas.

10. A method of removing undesirable gas from a container having an interior cavity and an opening for providing access to the interior cavity of the container, the container having a dough product disposed within the interior space of the container, said method comprising the steps of:

providing a displacement member including a piston portion that is sized and shaped to permit the piston portion to pass through the opening of the container, the piston portion also comprising at least one flushing gas supply passage having an outlet that opens through a surface of the piston portion;

positioning the displacement member relative to the container so that the container opening is aligned with the piston portion of the displacement member;

moving the displacement member and the container relatively toward one another so that the piston portion is inserted through the container opening and at least partially within the interior space of the container beyond a point at which a surface portion of the piston portion contacts the dough product within the interior space for compressing the dough product and forcing undesirable gas from the dough product, said step of moving the displacement member and the container relatively toward one another thereby causing a positive displacement of a quantity of undesirable gas from within the interior space of the container by forcing undesirable gas out of the dough product and from the interior space of the container by gas flow about the piston portion;

moving the displacement member and the container relatively away from one another so that the piston portion is taken out of contact with the dough product and until the piston portion is removed from the interior space of the container; and supplying flushing gas under a positive pressure within the flushing gas supply passage during the step of moving the displacement member and container relatively away from one another and while the outlet of the flushing gas supply passage is within the interior space of the container so that flushing gas is ejected into the interior space of the container.

11. The method of claim 10, wherein the compression of the dough product is stopped when a predetermined force is encountered by the piston portion.

12. The method of claim 10, wherein the flushing gas is supplied at a rate sufficient to prevent creation of a vacuum within the interior space of the container while the displacement member and container move relatively away from one another.

13. The method of claim 12, wherein the flushing gas is directed from the outlet of the flushing gas supply passage so as to impinge onto a surface of the dough product.

14. The method of claim 12, wherein flushing gas is also supplied while the displacement member and container move relatively toward one another including while the dough product is compressed.

15. The method of claim 12, wherein the piston portion is shaped similar to the opening of the container and is sized so as to permit passage of the piston portion into the interior space of the container, but to allow flow of undesirable gas from the interior space of the container between the piston portion and the container, the piston portion thus providing a surface for contacting substantially all of an exposed surface area of the dough product when the contact between the piston portion surface and dough product occurs.

16. The method of claim 12, further comprising a step of sealing the container in an environment that is free of the undesirable gas after said step of moving the displacement member and the container relatively away from one another is conducted to a point where the piston portion is removed from the container.

17. The method of claim 16, wherein the step of supplying flushing gas comprises supplying $CO_2$ as the flushing gas and the sealing step is conducted in an environment comprising $CO_2$ so that $CO_2$ is sealed within the interior space of the container.

18. The method of claim 10, wherein the step of supplying flushing gas comprises supplying $CO_2$ as the flushing gas.

* * * * *